United States Patent [19]

Heuberger et al.

[11] Patent Number: 4,572,422

[45] Date of Patent: Feb. 25, 1986

[54] CONTAINER WITH INNER POUCH AND RECLOSABLE SPOUT

[75] Inventors: Erich Heuberger, Trugenhofen; Wolf-Dieter Knörrich; Karl-Josef Ehrhart, both of Heidenheim, all of Fed. Rep. of Germany

[73] Assignee: Carl Edelmann Verpackungstechnik GmbH, Fed. Rep. of Germany

[21] Appl. No.: 655,104

[22] Filed: Sep. 27, 1984

[30] Foreign Application Priority Data

Oct. 5, 1983 [DE] Fed. Rep. of Germany ..... 3336269

[51] Int. Cl.[4] ..... B65D 1/08

[52] U.S. Cl. ..... 229/7 R; 229/17 M; 220/462; 220/463; 222/530

[58] Field of Search ..... 229/7 R, 17 M; 220/462, 220/463; 222/143, 527, 529, 530, 538, 539

[56] References Cited

U.S. PATENT DOCUMENTS

| | | | |
|---|---|---|---|
| 2,177,918 | 10/1939 | Vogt et al. | 220/463 |
| 2,386,062 | 10/1945 | Roehrl | 220/463 |
| 2,454,919 | 11/1948 | Hagan | 229/7 R |
| 2,819,000 | 1/1958 | Boguss et al. | 229/17 M |
| 2,973,119 | 2/1961 | Parker | 229/7 R |
| 3,108,732 | 10/1963 | Curie et al. | 229/7 R |
| 3,132,789 | 5/1964 | Forrest | 220/462 |
| 3,157,342 | 11/1964 | Grady | 220/463 |
| 3,173,579 | 3/1965 | Curie et al. | 229/7 R |
| 3,204,827 | 9/1965 | Krautkramer | 222/143 |
| 3,206,093 | 9/1965 | King | 229/7 R |
| 3,613,966 | 10/1971 | Summers | 222/529 |
| 3,638,834 | 2/1972 | Goodrich et al. | 222/530 |
| 3,746,240 | 7/1973 | Flynn | 220/462 |
| 3,861,577 | 1/1975 | Druyts | 229/7 R |
| 3,887,125 | 6/1975 | Trentesaux | 229/7 R |

*Primary Examiner*—Joseph Man-Fu Moy
*Assistant Examiner*—David Fidei
*Attorney, Agent, or Firm*—Erwin S. Teltscher

[57] ABSTRACT

A container with an inner pouch, particularly for liquids such as oil, vinegar or fruit juices or for bulk goods or the like, consisting of an outer cardboard shell such as that used in folding boxes, with bottom flaps and top flaps respectively connected together, particularly glued together, and a leakproof inner pouch closed at its upper and/or lower ends by a sealed or welded seam and having a closable spout projecting through an opening in one wall of the shell, wherein the upper portion (17) of one of the two narrow side walls (18), containing the opening (16) for the spout (15) connected with the inner pouch (12), is inwardly inclined when the container is closed and the upper triangular wall portions (19) of the two wider side walls (20), located adjacent to the inclined upper narrow wall portion (17), are folded inwardly along their angle bisectors (21).

7 Claims, 7 Drawing Figures

CONTAINER WITH INNER POUCH AND RECLOSABLE SPOUT

BACKGROUND OF THE INVENTION

The invention refers to a container with an inner pouch, particularly for liquids such as oil, vinegar or fruit juices of for bulk goods or the like, consisting of an outer cardboard shell such as that used in folding boxes, with bottom flaps and top flaps respectively connected, particularly glued, together and further consisting of a leakproof inner pouch closed at its upper and/or lower ends by a sealed or welded seam and having a closable spout projecting through an opening in one wall of the shell.

Containers of the aforegiven type are already known in the widest variety of embodiments. However, there are no practically useful containers of this type which, in spite of the use of a reclosable cap, can be fully automatically manufactured, set up, filled and closed in a simple manner. Practical experience demands of such containers that the cap be arranged and designed in such a manner that the interior of the container can be filled to the utmost extent. This means that the spout with the cap must be located as high as possible on the upper end of the container. With inner-lined containers of the type in consideration here, the spouts can only be located in a side wall, a fact which arises of necessity from the nature of such containers.

For the solution of the task on which the invention is based, the suggestion according to the invention is to design the container with an inner pouch in such a way that the upper portion of one of the two narrow side walls, containing the opening for the spout connected with the inner pouch to pass through, is inwardly inclined when the container is closed, and that the upper triangular portions of the two wider side walls, located adjacent to the inclined upper portion of the narrow side wall, are folded inwardly along their angle bisectors.

Additional features of this container according to the invention can be seen in the further claims and the following description of a preferred embodiment as shown in FIGS. 1 to 6, which is described in more detail below.

DETAILED DESCRIPTION OF THE DRAWINGS

Figure 1:
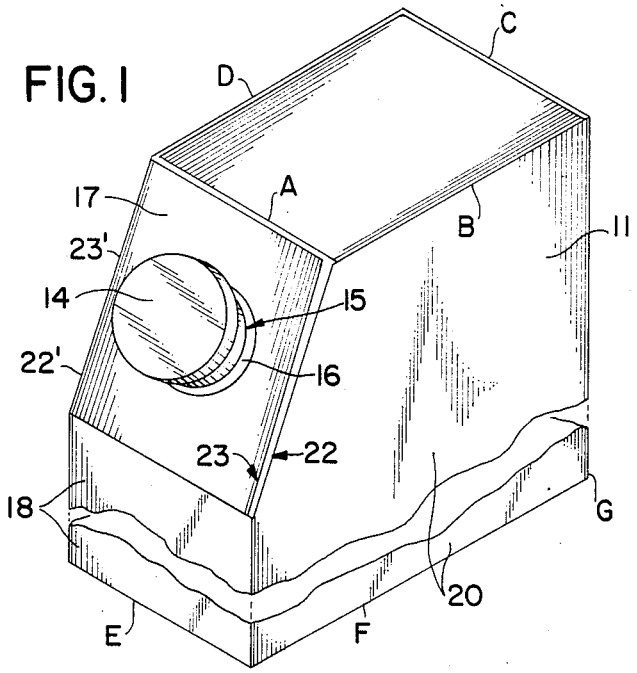
FIG. 1 shows a perspective view of the container according to the invention.
Figure 2:
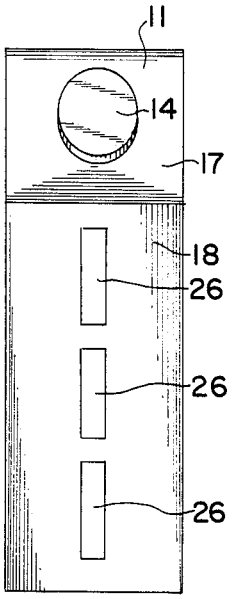
FIG. 2 shows a front view of the narrow side wall, containing the closable spout, in the container according to FIG. 1.
Figure 3:
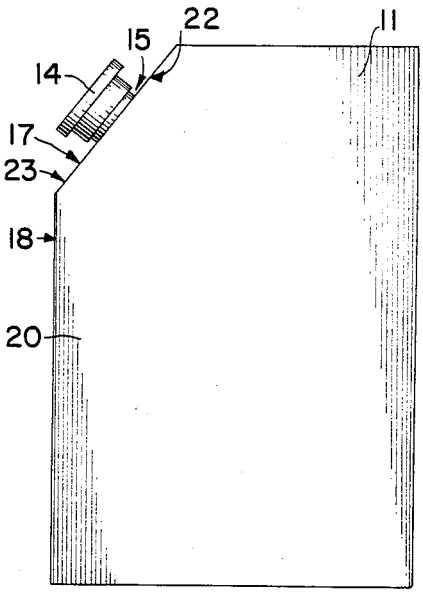
FIG. 3 shows a side view of the container according to FIGS. 1 and 2.

The container shown in FIGS. 1 to 4 comprises, as usual, the outer shell (11) and the inner pouch (12). After the container is set up, the inner pouch (12) is filled and its upper end is closed with a lengthwise seam (13). The spout (15) provided with a reclosable cap (14) is soundly and tightly connected to the inner pouch (12) by means of a flange and extends outwardly to the outside of the container through an opening (16) in the upper portion (17) of the narrow side wall (18). In order that the cap (14) not project beyond the outermost contours of the parallelepiped configuration of the container, the upper side wall portion (17) is inwardly inclined. This can be achieved according to the invention in a simple manner, in that when the container is sealed after the inner pouch (12) has been filed, the upper, triangular portions (19) of the wider side walls (20), located adjacent to the inclined upper narrow side wall portion (17), are folded in towards the interior on their angle bisectors (21) and along the creases (22) and (23). The creases (21, 22 and 23) are designed such that when pressure is applied to the upper narrow side wall portion (17), the two halves (24) and (25) of the triangular wall portion (19) of the side walls (20) independently tilt inwardly until they lie on top of one another. It is advantageous to adhere these two superposed halves (24) and (25) of the triangular wall portion (19) together, thereby improving the stability of the package in the area of the spout (15).

Figure 1A:
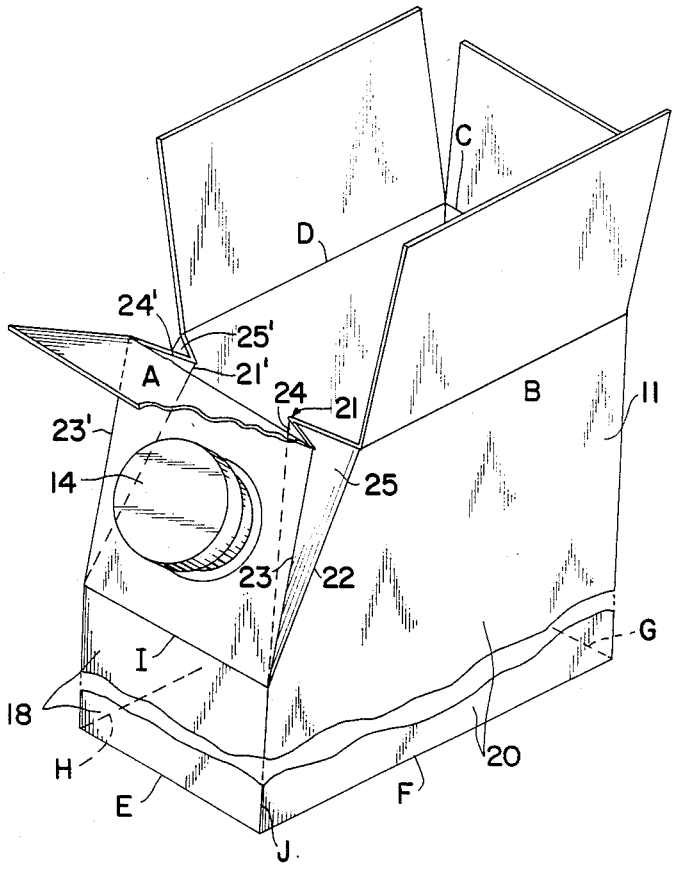
FIG. 1*a* shows a perspective view of the container according to the invention, before closing of the container lid.
Figure 4:
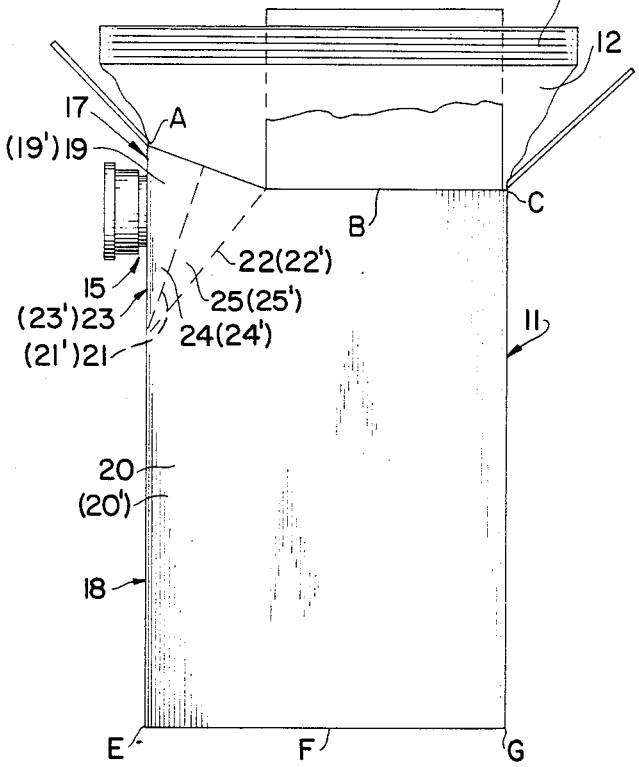
FIG. 4 shows a side view of the container according to FIG. 1, prior to being closed.

As can be seen from the drawing, the reference numerals provided with primes identify the elements which are similar to the elements identified by reference numerals without any primes, and pertain to the side wall which is opposite to the side wall 20 shown in FIG. 1A. Reference letters J, K, identify side folding lines along which the lower side wall portion 18 is connected with the side walls 20 and 20′. The reference letters A, B, C, D identify the top folding lines along which the top flaps are connected with the side walls. The reference letters E, F, G, H identify the bottom folding lines along which the bottom flaps are connected with the side walls. Finally, reference letter I identifies a front folding line along which the upper side wall portion 17 is connected with the lower side wall portion 18.

It is advantageous to adhere the inner pouch, especially at its upper end, to the side walls of the container, either pointwise or over large areas, but particularly in the area around the opening (16) in the upper side wall portion (17) and in the area of the triangular side wall portions (19) of the side walls (20). Of course the inner pouch can be adhered to the outer shell at additional points as well if this proves to be necessary.

A further improvement in the rigidity in the vicinity of the spout can be achieved by connecting together the inner pouch portions between the inclined upper side wall portion (17) and the bordering folded side wall halves (24), for example by sealing or welding, which can be done simply by applying a tong-shaped tool.

The further closing of the container after inwardly inclining the upper narrow side wall portion (17) occurs in the conventional manner, i.e. the top flaps joined onto the side walls of the container are folded inwardly, wherein the uppermost top flap is adhered to the one lying below.

In using transparent inner pouches (12) it is advantageous to provide windows (26), for instance in one of the side walls, more suitably in the side wall (18), through which windows the contents of the container and the degree of fullness can be seen.

Figure 5:
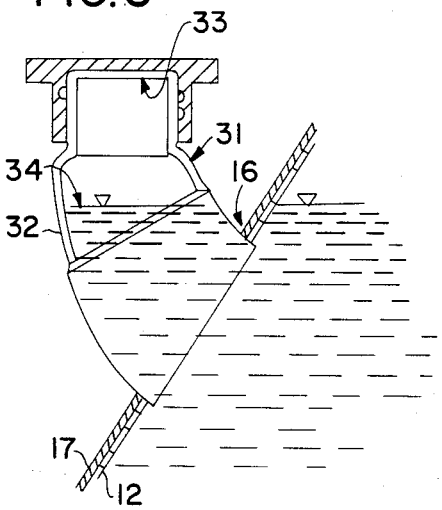
FIG. 5 shows a cross section through a particularly suitable spout capable of being pushed into the container and pulled out of the same, shown here in the extended position.
Figure 6:
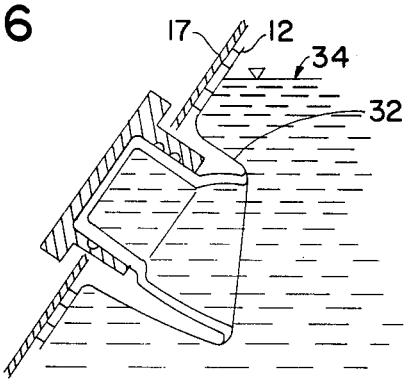
FIG. 6 shows a cross section through the spout according to FIG. 5, in the pushed-in position.

Since in the containers according to FIGS. 1 to 4 the spouts are to be provided a certain distance below the container top, the container can only be filled up to a level immediately below the lower edge of the spout. This is necessary in order to avoid spillage from the open spout when the container is set down after having been opened. In using a spout according to FIGS. 5 and 6, the capacity of the package can be far more completely exploited. The spout (31) is made up of a hose piece (32) of a flexible material, which can be inverted at least partially when force is exerted upon it in an axial direction, as shown particularly clearly in FIG. 6. In this position, the hose piece (32) of the spout projects into the interior of the container. In the position shown in FIG. 5, in which the hose piece (32) is extended, the mouth (33) of the spout (31) is sufficiently far above the fluid level (34) when the package is filled to maximum capacity.

The hose piece (32) of the spout (31) can be straight or arched. The latter is somewhat more advantageous, as the hose piece can be kept shorter.

We claim:

1. In a container, particularly for liquids such as oil, vinegar and fruit juices, or bulk goods and the like including a liquid-tight inner pouch (12), a spout (15) connected with the inner pouch (12), and an outer shell (11) which accommodates the inner pouch (12) and through which the spout (15) extends, the outer shell (11) having a plurality of side walls including a first side wall (17, 18) and two adjacent side walls (20, 20') connected with said first side wall (17,18) at each lateral side of the latter, respectively, along side folding lines (J,K), a plurality of top flaps connected with the side walls along top folding lines (A, B, C, D) and connected with each other, so that after closing of the outer shell (11) they form a closed top, and a plurality of bottom flaps connected with the side walls along bottom folding lines (E, F, G, H,) and connected with each other so that after closing of the outer shell they form a closed bottom, the improvement comprising that the first side wall (17,18) has a lower wall portion (18), and and upper wall portion (17) which has an opening (16) for extending the spout (15), and is connected with the upper wall portion (17) along a front folding line (I) which is parallel to a corresponding top and bottom folding line, so that before closing of the outer shell (11) the upper wall portion (17) and the lower wall portion (18) are located in one plane, while after closing of the outer shell (11) the upper wall portion (17) is inclined inwardly, that each of the adjacent side walls (20, 20') has a triangular wall portion (19, 19') with an apex lying on the front folding line (I), that each of the triangular wall portions (19, 19') has two lateral longitudinal sides connected, respectively, with the upper wall portion (17), and with the remaining portion of the respective adjacent side wall (20, 20') along two longitudinal folding lines (23, 22; 23', 22') and that it also has a central folding line (21, 21') extending from the front folding line (I) and subdividing each triangular wall portion (19, 19') into two halves so that before closing of the outer shell (11) each triangular wall portion (19, 19') lies in one plane with the remaining wall portion of the respective adjacent side wall (20, 20'), while after closing of the outer shell (11) each triangular wall portion (19, 19') is folded inwardly, and its central folding line (21, 21') lies inside of the outer shell (11), while its longitudinal folding lines (23, 22; 23' 22') coincide with one another, thereby reinforcing said upper wall portion (17).

2. A container with an inner pouch according to claim 1, characterized in that the two halves (24, 25) of the triangular wall portions (19) are glued together.

3. A container with an inner pouch according to claim 1, characterized in that the inner pouch (12) is glued to the two halves (24, 25) of the triangular wall portions (19) and to the upper inclined wall portion (17) at least in the area surrounding the spout opening (16).

4. A container with an inner pouch according to claim 3, characterized in that the inner pouch portions lying between the upper inclined wall portion (17) and the folded-in halves (24) adjacent thereto are connected together.

5. A container with an inner pouch according to claim 1, characterized in that the spout (31) is provided with a reclosable cap (14) and tightly connected by means of a flange to the inner pouch (12), and comprises a hose piece (32) of a flexible material and capable of being at least partly inverted upon exertion of an axial force, such that in one position thereof said hose piece projects inwardly into the interior of the container and in the other position thereof it is sufficiently far outside of the container so that the opening (33) of the spout (31) is located above the liquid level (34) of the container contents.

6. A container with an inner pouch according to claim 5, characterized in that the spout (31) is arched.

7. A container with an inner pouch according to claim 1, characterized in that the inner pouch (12) is glued in places to the shell (11), particularly at the upper and lower ends of the container.

* * * * *